US010519529B2

(12) United States Patent
Wright et al.

(10) Patent No.: US 10,519,529 B2
(45) Date of Patent: Dec. 31, 2019

(54) NICKEL-BASED ALLOYS

(71) Applicant: QuesTek Innovations LLC, Evanston, IL (US)

(72) Inventors: James A. Wright, Los Gatos, CA (US); Weiming Huang, State College, PA (US); Abhijeet Misra, Mountain View, CA (US); Jeremy Hoishun Li, Sunnyvale, CA (US); Jiadong Gong, Evanston, IL (US); Dana J. Frankel, Chicago, IL (US)

(73) Assignee: QUESTEK INNOVATIONS LLC, Evanston, IL (US)

( * ) Notice: Subject to any disclaimer, the term of this patent is extended or adjusted under 35 U.S.C. 154(b) by 448 days.

(21) Appl. No.: 14/548,488

(22) Filed: Nov. 20, 2014

(65) Prior Publication Data

US 2016/0222490 A1 Aug. 4, 2016

Related U.S. Application Data

(60) Provisional application No. 61/906,512, filed on Nov. 20, 2013.

(51) Int. Cl.

| | |
|---|---|
| ***C22F 1/10*** | (2006.01) |
| ***C22C 19/05*** | (2006.01) |
| ***C22C 1/02*** | (2006.01) |
| ***F28F 21/08*** | (2006.01) |

(52) U.S. Cl.

CPC ..... *C22C 19/055* (2013.01); *C22C 1/023* (2013.01); *C22F 1/10* (2013.01); *F28F 21/087* (2013.01)

(58) Field of Classification Search

CPC ..... C22C 19/055; C22F 1/10; F28F 21/087
USPC ..... 420/442
See application file for complete search history.

(56) References Cited

U.S. PATENT DOCUMENTS

| | | | | |
|---|---|---|---|---|
| 4,108,648 | A | 8/1978 | Zhurkina et al. | |
| 4,749,546 | A | 6/1988 | Burley | |
| 5,010,316 | A * | 4/1991 | Burley | C22C 19/05 174/102 A |
| 5,372,662 | A * | 12/1994 | Ganesan | C22C 19/056 148/428 |
| 5,529,642 | A | 6/1996 | Sugahara et al. | |
| 5,879,818 | A | 3/1999 | Kinomura et al. | |
| 5,882,586 | A | 3/1999 | Tamura et al. | |
| 5,972,289 | A | 10/1999 | Sikka et al. | |
| 6,004,408 | A | 12/1999 | Montagnon | |
| 6,605,164 | B2 | 8/2003 | Kennedy et al. | |
| 8,226,886 | B2 | 7/2012 | Hanlon et al. | |

(Continued)

OTHER PUBLICATIONS

Campbell, "Manufacturing Technology for Aerospace Structural Materials," 2006, p. 260-263.

*Primary Examiner* — Jie Yang
(74) *Attorney, Agent, or Firm* — Michael Best & Friedrich LLP

(57) ABSTRACT

An alloy includes, in weight percentage, about 20.0% to about 25.0% chromium, 0% to about 5.0% molybdenum, about 3.0% to about 15.0% cobalt, about 1.5% to about 6.0% niobium, about 1.0% to about 3.0% tantalum, about 1.0% to about 5.0% tungsten, 0% to about 1.0% aluminum, 0% to about 0.05% carbon, 0% to about 0.01% titanium, and the balance nickel and incidental elements and impurities, wherein the alloy includes $L1_2$ and $D0_{22}$ precipitates in a compact morphology.

18 Claims, 7 Drawing Sheets

(56) References Cited

U.S. PATENT DOCUMENTS

| | | | |
|---|---|---|---|
| 2007/0227630 | A1 | 10/2007 | Augustins Lecallier et al. |
| 2010/0080729 | A1 | 4/2010 | Biondo et al. |
| 2010/0272597 | A1 | 10/2010 | Qiao et al. |
| 2010/0279148 | A1 | 11/2010 | Hu |

* cited by examiner

NICKEL-BASED ALLOYS

CROSS-REFERENCE TO RELATED APPLICATIONS

This application claims priority to U.S. Provisional Application 61/906,512, filed Nov. 20, 2013, and is herein incorporated by reference in its entirety.

FEDERALLY-SPONSORED RESEARCH AND DEVELOPMENT

Activities relating to the development of the subject matter of this invention were funded at least in part by the U.S. Government, NSF Award Number 0839678 and Department of the Air Force Contract Number FA8650-09-D-2921, and thus the U.S. may have certain rights in the invention.

BACKGROUND

Aircraft with a turbine engine compressor output hot air. Heat exchangers can bleed this hot air over stacks of fins and thereby control the environmental temperature in aircrafts and also increase efficiency of the engine. Each fin measures generally below 0.3 mm in thickness and is shaped to maximize the surface-to-volume ratio. The fins are typically brazed on a base metal at a temperature above about 1040° C., after which the fin stacks are welded to the aircraft. Since the fins undergo thermal cycles during operation, they are expected to show adequate resistance to thermal fatigue. One way to increase the resistance to thermal fatigue is to employ thicker fins. However, thicker fins may add undesirable weight to the aircraft and decrease the thermal conductance.

Current materials for heat exchangers can withstand only a limited range of temperature. For example, solid-solution-strengthened commercial nickel-based alloys such as Inconel 625, with a nominal composition of 21 Cr, less than 5 Fe, 3.7 Nb, 1 Co, less than 0.5 Mn, less than 0.5 Si, 0.4 Ti, less than 0.4 Al, less than 0.1 C, and the balance Ni, in wt %, show low resistance to creep and low thermal conductivity at high temperatures. Other alloys such as Haynes® 282®, with a nominal composition of 20 Cr, 10 Co, 8.5 Mo, 2.1 Ti, 1.5 Al, 1.5 Fe, 0.3 Mn, 0.15 Si, 0.06 C, 0.005 B, and the balance Ni, in wt %, are strengthened by $L1_2$-$Ni_3$(Al, Ti) precipitates. Precipitation-strengthened alloys generally have a lower solute content in the matrix compared to solid-solution-strengthened alloys. This can result in less distortion of the crystal lattice of the matrix and therefore higher thermal conductivity. However, the higher contents of Al and Ti required for the $L1_2$ precipitation can also undesirably promote oxide formation during brazing, resulting in ineffective wetting of the braze alloy on the base metal and a poor braze quality.

SUMMARY

In an aspect the disclosure relates to an alloy comprising, in weight percentage, about 20.0% to about 25.0% chromium, 0% to about 5.0% molybdenum, about 3.0% to about 15.0% cobalt, about 1.5% to about 6.0% niobium, about 1.0% to about 3.0% tantalum, about 1.0% to about 5.0% tungsten, 0% to about 1.0% aluminum, 0% to about 0.05% carbon, 0% to about 0.01% titanium, and the balance nickel and incidental elements and impurities, wherein the alloy includes $L1_2$ and $D0_{22}$ precipitates in a compact morphology.

In another aspect the disclosure relates to a method of producing an alloy, the method comprising: melting an alloy that includes, in weight percentage, about 20.0% to about 25.0% chromium, 0% to about 5.0% molybdenum, about 3.0% to about 15.0% cobalt, about 1.5% to about 6.0% niobium, about 1.0% to about 3.0% tantalum, about 1.0% to about 5.0% tungsten, 0% to about 1.0% aluminum, 0% to about 0.05% carbon, 0% to about 0.01% titanium, and the balance nickel and incidental elements and impurities; subjecting the alloy to a homogenization heat treatment at about 1125° C. for about 24 hours to about 48 hours; and subjecting the alloy to an aging heat treatment at about 760° C. for about 24 hours or more.

Other aspects and embodiments will become apparent in light of the following description and accompanying drawings.

DETAILED DESCRIPTION

Figure 1:
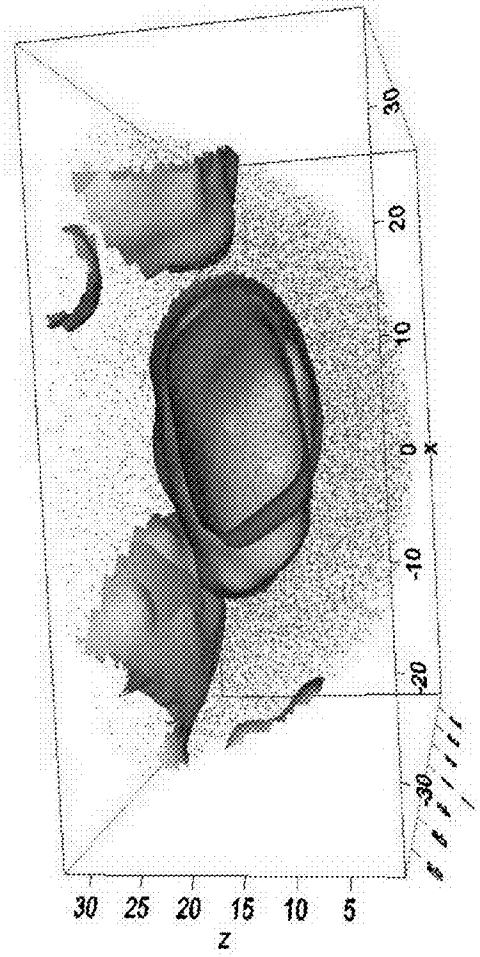
FIG. 1 is a 3-dimensional computer reconstruction of a microstructure of an embodiment of an alloy, produced using atom-probe tomography.

Aspects relate to alloys, manufactured articles comprising the alloys, and methods for producing the alloys, as described herein.

As used herein, terms such as "face-centered cubic" or "FCC," "$L1_2$ phase," and "$D0_{22}$ phase" include definitions that are generally known in the art.

As Applicants have identified aspects and embodiments that relate to materials including useful ranges of components or elements, any recited range described herein is to be understood to encompass and include all values within that range, without the necessity for an explicit recitation. Use of the word "about" to describe a particular recited amount or range of amounts is meant to indicate that values near to the recited amount are included in that amount, such as, but not limited to, values that could or naturally would be accounted for due to instrument and/or human error in forming measurements, and values that do not substantially affect the properties or nature of the disclosed alloys.

In an aspect, the disclosed alloys are nickel-based and suitably provide high strength at high operating temperatures. In an embodiment, the alloys utilize both $D0_{22}$-$Ni_3$(Nb, Ta) and $L1_2$-$Ni_3$(Al, Ti) for strengthening, in a nickel-based FCC matrix. Both precipitates are ordered phases, in which elements appear alternately on crystal lattice sites. During deformation of the alloys, the ordering of the elements is disrupted in the precipitates, giving rise to an antiphase-boundary energy, which can further strengthen the alloys.

According to another aspect, the disclosed alloys provide a high-temperature strength and a thermal conductivity comparable to those of Haynes 282, and can also be suitably brazed on a base metal. In some embodiments, the combination of aluminum and titanium in the alloy is maintained to, by weight, about 0.1% to about 1%. A reason to maintain this weight percent is that aluminum and titanium may form oxides on a brazing surface of the nickel-based alloy. These oxides may interfere with the braze flux, as a result of which the nickel-based alloy may not sufficiently wet with a base metal, leading to a poor braze quality. Although brazing under controlled conditions may improve the surface-wetting, this may increase the cost of operation. The disclosed alloys can be suitably brazed on a base metal with conventional techniques, for example, techniques that are applicable to Inconel 625. Relevant brazing techniques are disclosed in Flake C. Campbell, Manufacturing Technology for Aerospace Structural Materials 260-263 (2006) (incorporated by reference herein).

In some embodiments, the alloys comprise, in weight percentage, 0% to about 0.01% titanium. Titanium may participate in the formation of undesirable phases such as the η phase. In some embodiments, the addition of titanium is therefore limited to no more than about 0.01% in weight percentage. In further embodiments, titanium is not added in the alloy, such that the strengthening phase $L1_2$ is formed predominantly of $Ni_3Al$ instead of $Ni_3$(Al, Ti).

Maintaining the combination of aluminum and titanium to, by weight, about 0.1% to about 1% may have the effect of limiting the volume fraction of the strengthening phase $L1_2$. In some embodiments, the disclosed alloys therefore provide additional strengthening with $D0_{22}$-$Ni_3$(Nb, Ta) precipitates. In further embodiments, the sum of the volume fractions of $L1_2$ and $D0_{22}$ is comparable to the volume fraction of $L1_2$ in Haynes 282, namely about 0.134 at about 760° C.

In some embodiments, the disclosed alloys comprise, in weight percentage, about 1.5% to about 6.0% niobium, and about 1.0% to about 3.0% tantalum to form $D0_{22}$ precipitates. The addition of niobium and tantalum is not expected to compromise the brazeability of the alloys because these elements are less reactive in air than aluminum or titanium. Moreover, the addition of niobium unexpectedly reduces the solidification temperature range, thereby suitably preventing hot-tearing or hot-cracking during welding. The solidification temperature range may be reduced due to the tendency of niobium to form MC-type carbides in the fusion zone during re-solidification. The addition of tantalum can suitably increase the solvus temperature of the $L1_2$ phase, retard the coarsening kinetics of the $L1_2$ precipitates, and increase the creep resistance of the alloy at high temperatures, all of which are desirable for certain high-temperature applications.

In some embodiments, the alloys comprise, in weight percentage, about 3.0% to about 15.0% cobalt. The addition of cobalt can improve the high-temperature strength and maintain a good thermal conductivity for the alloys. As for the alloy strength, cobalt can decrease the solubility of solute elements in the matrix, causing them to precipitate instead of remaining in solid solution. Therefore, by increasing the cobalt content, more solute atoms will form precipitates. Furthermore, the addition of cobalt can increase the driving force for precipitation. Even though cobalt does not substantially partition to the precipitate phases, it nonetheless can increase the overall phase fraction of precipitates at a given amount of $L1_2$ and $D0_{22}$ formers. As for the thermal conductivity, cobalt is similar to nickel in atomic size and thus introduces little lattice distortion to the matrix. Thus, the addition of cobalt does not substantially reduce the thermal conductivity of nickel-based alloys. However, adding more than about 15.0% by weight of cobalt can result in undesirable phases such as μ and σ.

In some embodiments, the alloys comprise, in weight percentage, 0% to about 5.0% molybdenum, and about 1.0% to about 5.0% tungsten. Molybdenum and tungsten mostly remain in solid solution of the nickel-based matrix. As such, molybdenum and tungsten may provide corrosion resistance for the alloy. Both of these elements, however, have a large atomic size, and may therefore distort the crystal lattice of the matrix. The lattice distortion can reduce the thermal conductivity of the alloy. Furthermore, when added in excessive amounts, molybdenum and tungsten can promote the precipitation of undesirable phases such as the P-phase, or other embrittling, topographically close-packed phases.

In some embodiments, the alloys comprise, in weight percentage, about 1.0% to about 3.0% tantalum. When partitioning to the $L1_2$, the added tantalum atoms can raise the solvus temperature of the $L1_2$ phase, which is desirable for certain high-temperature applications. Additionally, the addition of tantalum can increase the phase fraction of the $L1_2$ phase at a given amount of aluminum and may increase the creep strength of the alloy by reducing the diffusivity within the $L1_2$ phase. When partitioning to the $D0_{22}$, on the other hand, the addition of tantalum may further strengthen the alloys, and also help slowing down the coarsening of the precipitates, thereby maintaining a high strength at high operating temperatures over a period of time. Tantalum may be chemically similar to niobium, because it is in the same group V in the periodic table. Thus, tantalum may readily substitute for niobium in $D0_{22}$-$Ni_3Nb$ and form $D0_{22}$-$Ni_3$(Nb, Ta). The atomic size of tantalum, however, is bigger compared to niobium. Thus, tantalum, compared to niobium, may have a slower diffusion coefficient in a nickel matrix. The slower diffusion coefficient is desirable, because it can help slowing down the coarsening of the $D0_{22}$-$Ni_3$(Nb, Ta) precipitates, which in turn can help maintaining a high strength at high operating temperatures over a period of time.

In some embodiments, the alloys comprise, in weight percentage, 0% to about 0.05% carbon. The addition of carbon may facilitate the formation of MC carbide during solidification. The carbide formation may reduce the accumulation of stress during solidification, such as in welding or casting. However, when added in excessive amounts, carbon can promote the formation of $M_{23}C_6$, which can embrittle the alloy. Thus, in some embodiments, the alloys comprise, in weight percentage, no more than about 0.05% of carbon.

According to another aspect, the alloys include $L1_2$ and $D0_{22}$ precipitates in a compact morphology, where the $D0_{22}$ precipitates substantially or completely enclose an $L1_2$ precipitate. The $D0_{22}$ precipitates may form a diffusion barrier, preventing the growth of the $L1_2$ precipitate. As described above, $D0_{22}$ contains slow-diffusing elements such as niobium and tantalum. Therefore, the $D0_{22}$ on the outside of the compact morphology can be helpful in resisting the coarsening of precipitates at high temperatures.

FIG. 1 is a 3-dimensional computer reconstruction of an embodiment with a compact morphology of precipitates, where the $D0_{22}$ precipitates (in yellow) surround the $L1_2$ precipitates (in blue). The numbers in FIG. 1 are in nanometers. In the illustrated embodiment, the compact morphology includes multiple internal interfaces, which may be helpful for strengthening, more so than a dispersion consisting only of $L1_2$ precipitates.

In some embodiments, the alloys achieve a compact morphology of precipitates when the surface tension between the $L1_2$ phase and the FCC matrix is greater than the surface tension between the $L1_2$ phase and $D0_{22}$ phase. The alloys may favor a compact morphology of precipitates over a dispersed morphology, if the total strain energy of the former is less than that of the latter. Strain energy in an alloy is generally proportional to the lattice parameter mismatch between the various phases in the alloy. Thus, the total strain energy for an alloy with $L1_2$ and $D0_{22}$ precipitating separately in a dispersed morphology can be approximated by the following equation [1]:

$$G_{strain1}=A_{L1_2\text{-}matrix}\gamma_{L1_2\text{-}matrix}+A_{D0_{22}\text{-}matrix}\gamma_{D0_{22}\text{-}matrix} \quad [1]$$

where $A_{x\text{-}y}$ is the boundary area between x and y, and $\gamma_{x\text{-}y}$ is the surface tension between x and y. On the other hand, the total strain energy for an alloy with $D0_{22}$ precipitating over $L1_2$ in a compact morphology can be approximated by the following equation [2]:

$$G_{strain2}=A_{L1_2\text{-}D0_{22}}\gamma_{L1_2\text{-}D0_{22}}+A_{D0_{22}\text{-}matrix}\gamma_{D0_{22}\text{-}matrix} \quad [2]$$

If $G_{strain1}$ is greater than $G_{strain2}$, the alloy will favor a compact morphology of precipitates to lower its free energy. Assuming $A_{L1_2\text{-}matrix}\approx A_{L1_2\text{-}D0_{22}}$, this may mean that if $\gamma_{L1_2\text{-}matrix}>\gamma_{L1_2\text{-}D0_{22}}$, the alloy will favor a compact morphology of precipitates. Thus, in some embodiments the alloys achieve a compact morphology of precipitates when the surface tension between the $L1_2$ phase and the FCC matrix is greater than the surface tension between the $L1_2$ phase and $D0_{22}$ phase.

In some embodiments, the lattice parameters of the FCC matrix and the $L1_2$ and $D0_{22}$ precipitates are tuned such that the surface tension between the $L1_2$ phase and the FCC matrix is greater than the surface tension between the $L1_2$ phase and $D0_{22}$ phase. At room temperature, the lattice parameter of FCC-nickel is about 0.3520 nm, the lattice parameter of $L1_2$ is about 0.3572 nm, and the lattice parameters of $D0_{22}$ are about 0.3542 nm in the basal plane and about 0.7212 nm in a direction normal to the basal plane. In some embodiments, tantalum is added to the alloy such that the surface tensions between the various phases favor a compact morphology of precipitates. The addition of tantalum does not proportionally alter the lattice parameter of $D0_{22}$, because the partitioning ratio of tantalum to $D0_{22}$ is relatively constant regardless of amount added. Thus, a higher content of tantalum mainly serves to increase the volume fraction of $D0_{22}$, without proportionally expanding the lattice parameters of $D0_{22}$. On the other hand, the partitioning of tantalum to $L1_2$ does scale with the overall amount added. That is, the more tantalum is added, the more partitions to the $L1_2$. Because tantalum has a large atomic size, the higher partitioning can expand the lattice parameter of $L1_2$. Thus, the addition of tantalum is used in some embodiments to tune the lattice parameter of $L1_2$ and achieve a balance of lattice parameters that favors a compact morphology of precipitates.

Figure 2:
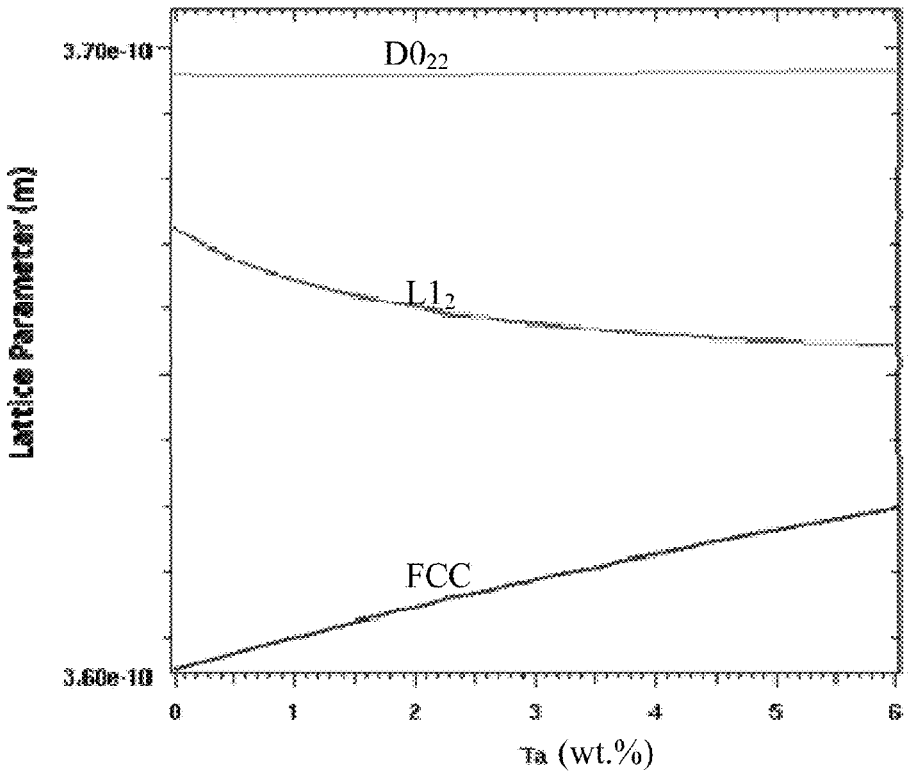
FIG. 2 is a graph plotting the calculated lattice parameters of $L1_2$, $D0_{22}$, and FCC-nickel matrix, as a function of tantalum addition, in weight percentage, for an embodiment of an alloy as described herein including, for example, FIG. 1.
Figure 3:
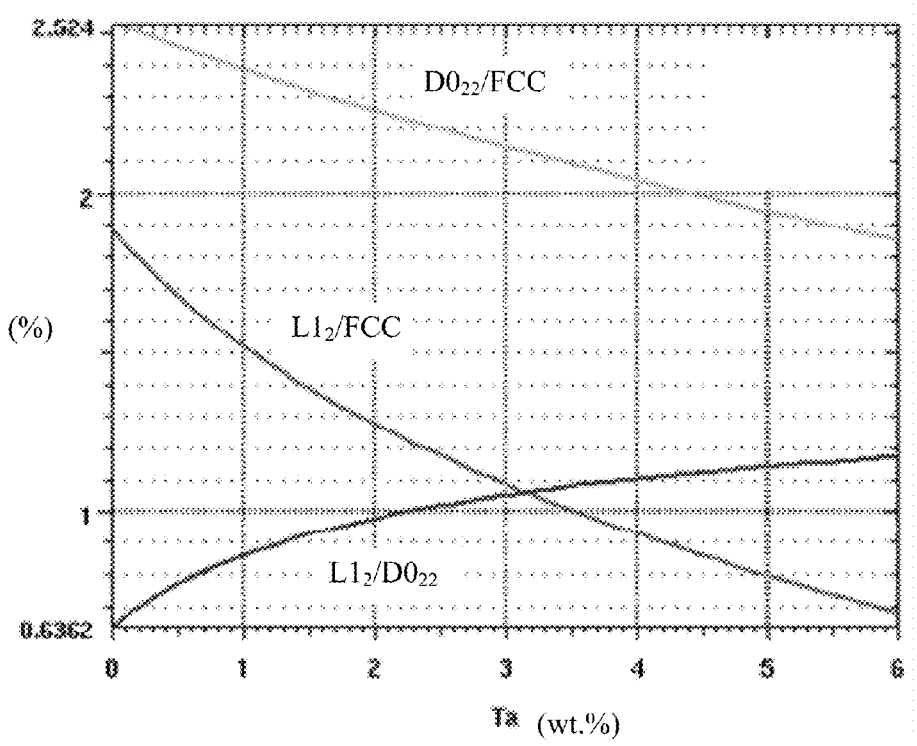
FIG. 3 is a graph plotting the calculated lattice misfit between $L1_2$, $D0_{22}$, and FCC nickel matrix, as a function of tantalum addition, in weight percentage, for an embodiment of an alloy as described herein, including, for example, the alloy of FIG. 1.

FIG. 2 is a graph plotting the calculated lattice parameters of $L1_2$, $D0_{22}$, and FCC-nickel matrix, as a function of tantalum addition, in weight percentage. FIG. 3 is a graph plotting the calculated lattice misfit between $L1_2$, $D0_{22}$, and FCC-nickel matrix, as a function of tantalum addition, in weight percentage. Adding more than about 3.5% by weight of tantalum can result in the lattice misfit between $L1_2$ and $D0_{22}$ exceeding that between $D0_{22}$ and FCC, which may make a compact-morphology formation energetically unfavorable.

In some embodiments, chemical elements such as molybdenum, tungsten, cobalt, and chromium are added to the alloy in amounts suitable to achieve a balance of lattice parameters that favors a compact morphology of precipitates. All of the elements molybdenum, tungsten, cobalt, and chromium mainly partition towards the matrix, and therefore may not substantially affect the lattice parameters of $L1_2$ and $D0_{22}$. Of these elements, those bigger than nickel, namely molybdenum and tungsten, may tend to expand the lattice parameter of the FCC-nickel matrix. On the other hand, those smaller than nickel, namely, cobalt and chromium, may tend to shrink the lattice parameter of the FCC-nickel matrix. Thus, in some embodiments, the amounts of molybdenum, tungsten, cobalt, and chromium are selected to tune the lattice parameter of the FCC-nickel matrix and obtain a balance of lattice parameters that favors a compact morphology of precipitates.

Illustrative embodiments of the alloys are described in greater detail below.

EXAMPLE

Alloy A

A melt was prepared by vacuum ingot metallurgy with the nominal composition, in weight percentage, of about 21.0% Cr, about 3.0% Mo, about 7.0% Co, about 4.0% Nb, about 2.0% Ta, about 3.0% W, about 1.0% Al, about 0.03% C, less than about 1.0% Ti, and the balance essentially Ni and unavoidable impurities. The melt weighed about 300 g. The alloy was homogenized after melting, but not hot-worked. The homogenization heat treatment was performed at about 1125° C. for about 48 hours, followed by quenching with water. The thermal conductivity of alloy 625 is about 0.198 W/cm·K, and that of Haynes 282 is about 0.248 W/cm·K. The thermal conductivity of Alloy A is expected to be at least that of Haynes 282. Alloy A in the homogenized and quenched state was successfully cold-rolled from a thickness of about 0.090 inches to about 0.017 inches, without any intermediate annealing steps. This represents a thickness reduction exceeding about 80%, and indicates an excellent formability at room temperature. The cold-rolled embodiment recovered nearly all of its strength upon subsequent annealing. An overall thickness reduction from about 60% to about 90% can be achieved for Alloy A by cold-rolling. Alloy A was aged at about 760° C. for about 24, about 48, and about 96 hours, followed by quenching with water.

Figure 4:
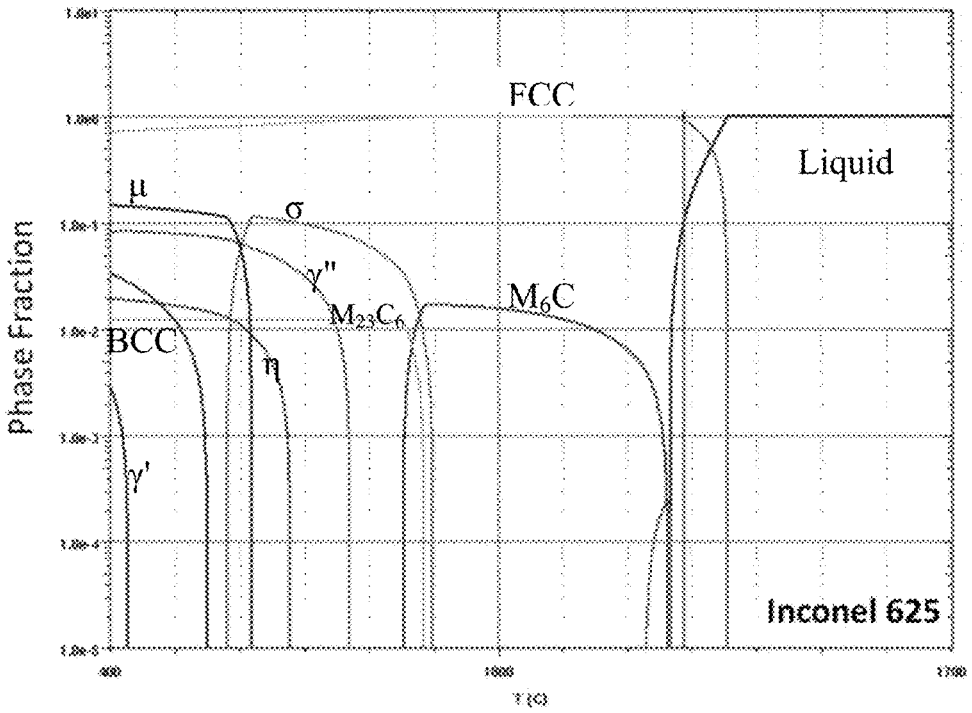
FIG. 4 is an equilibrium step diagram of Inconel 625.
Figure 5:
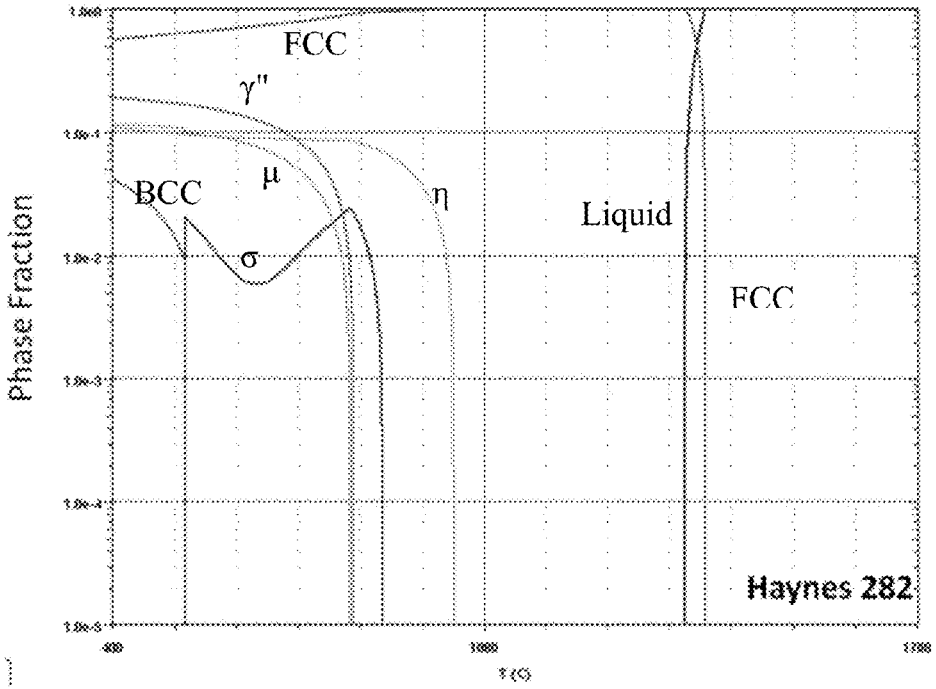
FIG. 5 is an equilibrium step diagram of Haynes 282.

FIG. 4 is an equilibrium step diagram of Inconel 625. At about 760° C., Inconel 625 has more than about 10% of the σ-phase. FIG. 5 is an equilibrium step diagram of Haynes 282. At 760° C., Haynes 282 has more than about 10% of the η-phase and more than about 1% of the σ-phase. The σ- and the η-phase are generally undesirable, because they form in large sizes and impart little strengthening. They are also brittle and can lock up elements that could otherwise be used for the precipitation of strengthening phases.

Figure 6:
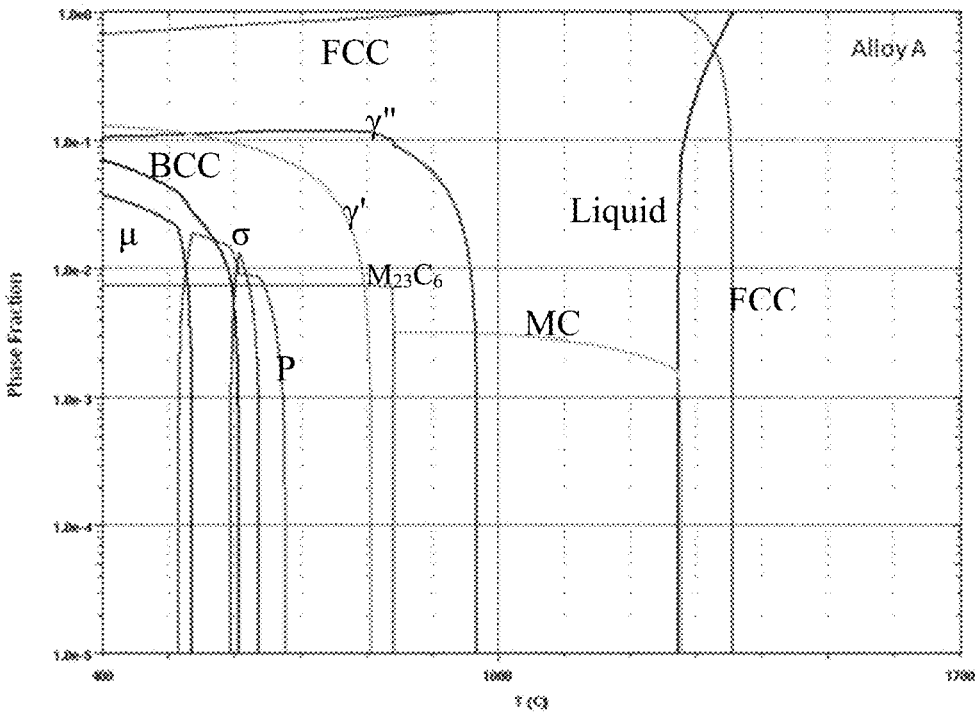
FIG. 6 is an equilibrium step diagram of an embodiment of an alloy as described herein, including, for example, the alloy of FIG. 1.

FIG. 6 is an equilibrium step diagram of Alloy A. In contrast to Inconel 625 and Haynes 282, Alloy A substantially avoids the undesirable σ- and η-phase at 760° C. By avoiding these phases, the fracture toughness and strength of Alloy A can be increased, which makes Alloy A suitable for components that are exposed to high temperatures for a long time.

Figure 7:
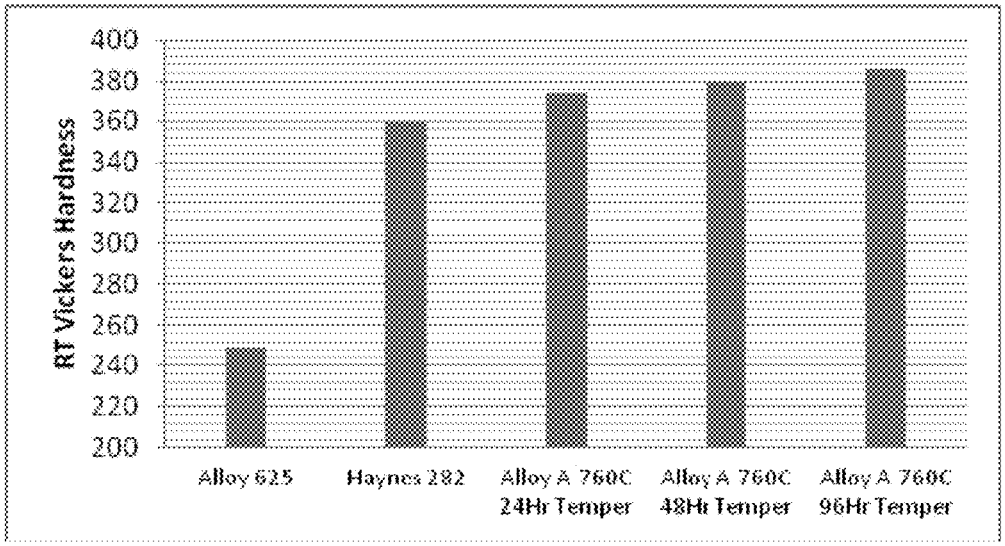
FIG. 7 is a graph plotting the Vickers Hardness Numbers of an embodiment of an alloy as described herein, including, for example, the alloy of FIG. 1, in comparison to aged Inconel 625 and Haynes 282.

FIG. 7 is a graph plotting the Vickers Hardness Number (VHN) of Alloy A. The ambient VHN of Alloy A aged at about 760° C. increased from about 375 to about 385 as the aging duration increased. In comparison, the ambient VHN of Inconel 625 and Haynes 282 in an aged condition measured about 249 and about 360, respectively. An atom-probe tomography of Alloy A in an aged condition showed nanoscale $L1_2$ and $D0_{22}$ precipitates in a compact morphology.

The following Table lists the compositions of two embodiments of the alloys, along with Inconel 625 and Haynes 282. Also listed are the calculated phase fractions of $L1_2$ and $D0_{22}$, the coarsening rate of $L1_2$, the solvus temperatures of $L1_2$ and $D0_{22}$, the Scheil solidification temperature range, and alloy cost. The alloy cost is estimated by the average market price of the ingredient elements, per pound.

TABLE

| | Inconel 625 | Haynes 282 | Alloy A | Alloy B |
|---|---|---|---|---|
| Cr | 21.5% | 20.0% | 21.0% | 25.0% |
| Mo | 8.5% | 8.5% | 3.0% | 0.0% |
| Nb | 3.65% | 0.00% | 4.00% | 3.50% |
| Ta | | 0.00% | 2.00% | 1.00% |
| Al | 0.4% max | 1.5% | 1.0% | 1.0% |
| Ti | 0.4% max | 2.1% | 0.0% | 0.0% |
| W | 0.0% | 0.0% | 1.0% | 2.5% |
| Co | 0% | 10% | 7% | 7% |
| C | 0.10% max | 0.06% | 0.03% | 0.03% |
| Fe | 5.0% max | 1.5% max | 0.0% | 0.0% |
| Ni | balance | balance | balance | balance |
| $L1_2$ phase fraction | 0.000 | 0.134 | 0.033 | 0.021 |
| $D0_{22}$ phase fraction | 0.007 | 0.000 | 0.106 | 0.088 |
| $L1_2$ solvus | | 994° C. | 877° C. | 874° C. |
| $D0_{22}$ solvus | | | 969° C. | 976° C. |
| Scheil dT | 115° C. | 102° C. | 91° C. | 107° C. |
| Alloy cost | $15.34 | $11.50 | $13.40 | $8.10 |

As described above, the various embodiments of alloys described herein can be used for various applications, including in heat exchangers. In particular, the alloy may provide excellent performance when used to construct fins for a heat exchanger. Such fins may be thin metal plates, or may have another structure. Accordingly, aspects of the subject invention also relate to fins for heat exchangers constructed using an alloy as described herein or a heat exchanger containing such fins, as well as other devices and articles constructed using such an alloy. Aspects of the subject invention may also include methods for manufacturing fins and/or heat exchangers using an alloy as described herein. Such a method for manufacturing a heat exchanger may include manufacturing one or more fins using an alloy as described herein and brazing the fin(s) to a base metal. Further aspects of the subject invention may include a method for creating an alloy as described herein, which may incorporate at least some of the processing steps described above.

It is understood that the invention may embody other specific forms without departing from the spirit or central characteristics thereof. The disclosure of aspects and embodiments, therefore, are to be considered as illustrative and not restrictive. While specific embodiments have been illustrated and described, other modifications may be made without significantly departing from the spirit of the invention.

The invention claimed is:

1. An alloy comprising, in weight percentage,
about 20.0% to about 25.0% chromium,
0% to 4% molybdenum,
about 3.0% to about 15.0% cobalt,
about 1.5% to about 6.0% niobium,
about 1.0% to about 3.0% tantalum,
about 1.0% to about 5.0% tungsten,
0% to about 1.0% aluminum,
0% to about 0.05% carbon,
0% to about 0.01% titanium,
and the balance nickel and incidental elements and impurities,
wherein the alloy includes $L1_2$ and $D0_{22}$ precipitates in a compact morphology;
wherein the ratio of the $D0_{22}$ phase fraction to the $L1_2$ phase fraction is about 3:1 to about 5:1, at about 760° C.; and
wherein the alloy has a Vickers Hardness Number of at least 360.

2. The alloy of claim 1, wherein the alloy comprises, in weight percentage, 0% to about 3.0% molybdenum, about 5.0% to about 10.0% cobalt, about 3.0% to about 4.0% niobium, about 1.0% to about 2.0% tantalum, about 1.0% to about 3.0% tungsten, about 0.02% to about 0.05% carbon, and the balance nickel and incidental elements and impurities.

3. The alloy of claim 1, wherein the combination of aluminum and titanium in the alloy is, by weight, about 0.1% to about 1.0%.

4. The alloy of claim 1, wherein titanium is not included in the alloy.

5. The alloy of claim 1, wherein the surface tension between the $L1_2$ phase and the FCC matrix is greater than the surface tension between the $L1_2$ phase and $D0_{22}$ phase.

6. The alloy of claim 1, wherein the alloy substantially avoids the σ- and η-phase at 760° C.

7. The alloy of claim 1, wherein the alloy has a Vickers Hardness Number of at least 360 after aging at 760° C. for 24 hours; wherein the alloy has a Vickers Hardness Number of at least 370 after aging at 760° C. for 48 hours; and wherein alloy has a Vickers Hardness Number of at least 380 after aging at 760° C. for 96 hours.

8. The alloy of claim 1, wherein the $L1_2$ solvus temperature is less than or equal to 900° C.

9. The alloy of claim 1, wherein the $D0_{22}$ solvus temperature is less than or equal to 1000° C.

10. The alloy of claim 1, wherein the Scheil solidification temperature range is less than 110° C.

11. The alloy of claim 1, wherein the Scheil solidification temperature range is less than 100° C.

12. The alloy of claim 1, wherein the alloy comprises, in weight percentage, about 21.0% chromium, about 3.0% molybdenum, about 7.0% cobalt, about 4.0% niobium, about 2.0% tantalum, about 1.0% tungsten, about 1.0% aluminum, about 0.03% carbon, and the balance nickel and incidental elements and impurities.

13. The alloy of claim 1, wherein the alloy comprises, in weight percentage, about 25.0% chromium, about 7.0% cobalt, about 3.5% niobium, about 1.0% tantalum, about 2.5% tungsten, about 1.0% aluminum, about 0.03% carbon, and the balance nickel and incidental elements and impurities.

14. A manufactured article comprising the alloy of claim 1.

15. The article of claim 14, wherein the article is a fin for a heat exchanger.

16. The alloy of claim 1, wherein the alloy comprises, in weight percentage, 0% to about 3.0% molybdenum, the balance nickel and incidental elements and impurities.

17. An alloy comprising, in weight percentage,
about 20.0% to about 25.0% chromium,
0% to about 5.0% molybdenum,
about 3.0% to about 15.0% cobalt,
about 1.5% to about 6.0% niobium,
about 1.0% to about 3.0% tantalum,
about 1.0% to about 5.0% tungsten,
0% to about 1.0% aluminum,
0% to about 0.05% carbon,
0% to about 0.01% titanium,
and the balance nickel and incidental elements and impurities,
wherein the alloy includes $L1_2$ and $D0_{22}$ precipitates in a compact morphology;
wherein the sum of the $L1_2$ phase fraction and the $D0_{22}$ phase fraction is about 0.1 to about 0.14; and
wherein the ratio of the $D0_{22}$ phase fraction to the $L1_2$ phase fraction is about 3:1 to about 5:1, at about 760° C.

18. The alloy of claim 17, wherein the $L1_2$ phase and the $D0_{22}$ phase are stable equilibrium phases at about 760° C.

* * * * *